US009546489B2

(12) United States Patent
Rosati

(10) Patent No.: US 9,546,489 B2
(45) Date of Patent: Jan. 17, 2017

(54) FORMWORK SUPPORT SCAFFOLD STRUCTURE

(71) Applicant: FORM 700 PTY LTD, Altona North, Victoria (AU)

(72) Inventor: Emilio Rosati, Rossmore (AU)

(73) Assignee: FORM 700 PTY LTD, Victoria (AU)

( * ) Notice: Subject to any disclaimer, the term of this patent is extended or adjusted under 35 U.S.C. 154(b) by 0 days.

(21) Appl. No.: 14/418,988

(22) PCT Filed: Aug. 2, 2013

(86) PCT No.: PCT/AU2013/000855

§ 371 (c)(1),
(2) Date: Feb. 2, 2015

(87) PCT Pub. No.: WO2014/019029

PCT Pub. Date: Feb. 6, 2014

(65) Prior Publication Data

US 2015/0197949 A1 Jul. 16, 2015

(30) Foreign Application Priority Data

Aug. 2, 2012 (AU) ..... 2012903312

(51) Int. Cl.
*E04G 11/48* (2006.01)
*E04G 1/14* (2006.01)
(Continued)

(52) U.S. Cl.
CPC ..... *E04G 11/483* (2013.01); *E04G 1/14* (2013.01); *E04G 1/18* (2013.01); *E04G 1/30* (2013.01);
(Continued)

(58) Field of Classification Search
CPC ..... E04G 1/18; E04G 1/14; E04G 1/30; E04G 5/16; E04G 11/00; E04G 11/38; E04G 11/483; E04G 25/00; E04G 25/061; E04G 2025/003; E04G 2001/305
See application file for complete search history.

(56) References Cited

U.S. PATENT DOCUMENTS 742,755 A * 10/1903 Uffelman ..... E04G 1/14 425/DIG. 126
2,043,498 A * 6/1936 Uecker ..... E04G 1/14 52/126.7
(Continued)

FOREIGN PATENT DOCUMENTS

CA 2284123 A1 3/2000
CN 201991215 U 9/2011
(Continued)

*Primary Examiner* — Michael Safavi
(74) *Attorney, Agent, or Firm* — Klauber & Jackson LLC

(57) ABSTRACT

This invention relates to a formwork support member, and a scaffold structure formed from at least a pair of adjacent formwork support members. The formwork support member comprises at least two spaced vertical members, at least one connecting member bridging said vertical members to form thereby a rigid formwork support member, each vertical member including a plurality of attachment means at spaced intervals there-along for releasable attachment thereto of at least one brace member extending between adjacent formwork support members to form the scaffold structure.

18 Claims, 11 Drawing Sheets

(51) Int. Cl.

| | |
|---|---|
| ***E04G 1/30*** | (2006.01) |
| ***E04G 5/16*** | (2006.01) |
| ***E04G 11/38*** | (2006.01) |
| ***E04G 1/18*** | (2006.01) |
| ***E04G 11/00*** | (2006.01) |
| ***E04G 25/00*** | (2006.01) |
| ***E04G 25/06*** | (2006.01) |

(52) U.S. Cl.
CPC ..... *E04G 5/16* (2013.01); *E04G 11/00* (2013.01); *E04G 11/38* (2013.01); *E04G 25/00* (2013.01); *E04G 25/061* (2013.01); *E04G 2001/305* (2013.01); *E04G 2025/003* (2013.01)

(56) References Cited

U.S. PATENT DOCUMENTS 2,462,429 A * 2/1949 Sachs ..... E04G 1/14 52/637
2,496,082 A * 1/1950 Ashenfelter ..... E04G 1/14 403/49
2,882,099 A * 4/1959 Symons ..... E04G 1/14 182/186.7
3,023,833 A * 3/1962 Hunnebeck ..... E04G 1/14 182/178.5
3,037,588 A * 6/1962 Causey ..... E04G 1/14 182/178.6
3,168,793 A * 2/1965 Gibson ..... A63H 33/088 403/173
4,026,079 A * 5/1977 Morris ..... E04G 1/14 182/180.1
6,161,359 A * 12/2000 Ono ..... E04G 11/48 14/75
2007/0045048 A1* 3/2007 Wyse ..... E04G 1/14 182/178.1
2010/0078263 A1* 4/2010 Kreller ..... E04G 1/14 182/113
2010/0089697 A1* 4/2010 Kreller ..... E04G 1/14 182/113
2012/0228060 A1* 9/2012 Rogers ..... E04G 1/06 182/178.5
2012/0298449 A1* 11/2012 Kreller ..... E04G 1/14 182/113
2013/0043095 A1* 2/2013 Thacker ..... E04G 1/14 182/186.7

FOREIGN PATENT DOCUMENTS

DE 102008006911 * 7/2009 ..... E04G 11/48
EP 0048624 3/1982
EP 1016766 7/2000
FR 2186042 A5 * 1/1974 ..... E04G 1/14
JP 10339031 A 12/1998
JP 2012132157 A 7/2012

* cited by examiner

FORMWORK SUPPORT SCAFFOLD STRUCTURE

CROSS REFERENCE TO RELATED APPLICATIONS

The present application is a National Stage Application claiming the priority of co-pending PCT Application No. PCT/AU2013/000855, filed Aug. 2, 2013, which in turn, claims priority from Australian application No. 2012903312, filed Aug. 2, 2012. Applicant claims the benefits of 35 U.S.C. §120 as to the PCT application and priority under 35 U.S.C. §119 as to the said Australian application, and the entire disclosures of both applications are incorporated herein by reference in their entireties.

TECHNICAL FIELD

This invention relates to a formwork support element used to form a rigid scaffolding structure for supporting formwork for concrete casting purposes.

BACKGROUND

Formwork is used in concrete construction to provide a mould or a surface onto which wet concrete can be poured for forming various elements such as floor slabs and beams for example. In the case of floor slabs, it is common for floors of a multi-story building to be formed sequentially and for formwork to be set out on a preceding floor in order to form the subsequent higher floor.

Such formwork normally comprises a frame or scaffolding that are used to support elevated forms comprising either lost formwork or formwork that can be removed from the concrete slab once the concrete is set. Reusable formwork may comprise aluminium formwork pans which are held at the top of the scaffolding. In addition, sheets or boards may also be used at the top of the framework.

The aluminium formwork pans are normally rectangular in plan form and have lips or edges extending downwardly from the formwork surface. These aluminium pans can be supported in forks which comprise of four upwardly directed fingers extending from a single vertical support which hold a corner each of four adjoining aluminium pans.

Normally, the scaffolding used to support the formwork is manually assembled from a number of discreet elements. These discreet elements include vertical tubular supports and bracing members which extend between adjacent vertical supports. It is common to provide a scaffold structure comprising four spaced vertical supports arranged in a rectangular plan form with a vertical support at each corner with the necessary bracing between the four vertical supports to hold each of the vertical supports upright. A fork is placed at the top of each vertical support with a screw jack in order to adjust the height of the fork prior to the aluminium formwork pans being put in place.

Each individual scaffold structure is spaced from adjacent scaffold structures by the width of the aluminium formwork pans so that a single formwork pan can bridge between each scaffold structure.

The construction of each scaffold structure is extremely labour intensive, time consuming and require a number of workers to hold each individual vertical support upright while the brace members are attached between individual vertical members so as to form a self-supporting structure.

It is against this background and the problems and difficulties associated therewith that the present invention has been developed.

Certain objects and advantages of the present invention will become apparent from the following description, taken in connection with the accompanying drawings, wherein, by way of illustration and example, an embodiment of the present invention is disclosed.

SUMMARY

According to a first aspect, there is provided a formwork support member comprising at least two spaced vertical members, at least one connecting member bridging said vertical members, each vertical member including a plurality of attachment means at spaced intervals there-along for releasable attachment thereto of at least one brace member extending between adjacent formwork support members to form a rigid structure.

Preferably, the formwork support member according to the above description is in a planar form but it may also include bracing members at an angle in a horizontal plane with respect to a first set of bracing members where three or more spaced vertical members are used. The connecting members may be releasable attached to each vertical member at their respective ends provided that such attachment forms a formwork support member having sufficient rigidity to be raised into a vertical position without significant relative movement between the vertical members and the connecting members. Preferably, the connecting members are welded to the vertical members, and further, the connecting members preferably positioned horizontally between the vertical members when the vertical members are in an upright position.

The attachment means on each vertical member enable releasable attachment of brace members between adjacent formwork support members. Preferably, a pair of formwork support members are secured to, one another by diagonal braces which extend from a lower attachment means positioned on one formwork support member to an upper attachment means on an adjacent formwork support member. Preferably, four diagonal braces are used between a pair of formwork support members to form a scaffold structure.

Horizontal brace members may extend between adjacent scaffold structures with each horizontal brace member attaching at either end to an attachment means on adjacent vertical members. This provides a means of holding each scaffold structure the correct distance apart for the reason that will be described below.

The upper end of each vertical member may support a fork and each fork may have a jacking extension comprising a screw threaded portion with a rotatable collar against which the base of the fork abuts to enable the fork to be raised or lowered to the required position. The fork has four projecting fingers, each finger being for supporting the corner of an aluminium formwork pan.

Alternatively, the upper end of each vertical member may be used to support a second formwork support member where each vertical member is attached to an adjacent lower vertical member of the lower formwork support member. A dowel is inserted into the upper end of each vertical member and also locates into the lower end of the upper vertical member. Brace members are used between the upper formwork support members to form a rigid structure.

In the case of formwork support structures comprising a number of stacked formwork support members, another aspect of the invention is the placement of deck elements between adjacent formwork support members to form an elevated working surface to enable easier access to the upper portions of the formwork support members for locating a second formwork support member on top of a lower support member. The deck elements have a panel with u-shaped connectors at either end where the u-shaped connectors locate over the upper surface of a horizontal brace member. This enables deck elements to be quickly positioned at a required height between adjacent formwork support members. Deck elements may also be used on single height formwork support members to enable location of formwork on the upper end.

Preferably, the first level of scaffold structures are assembled on a surface with the decking elements then being located within and between each of the scaffold structures. This then forms a continuous working surface across the assembly of the scaffold structures which then provides a very safe working environment for further construction of the scaffolding structure.

In an alternative, the attachment means comprise a number of u-shaped metal strips that are welded to each vertical member at locations spaced along each vertical member.

In a further aspect, the invention may be said to reside in a formwork support member comprising at least two spaced vertical members, a plurality of connecting members being attached at either end to one of said vertical members to form thereby a rigid formwork support member, and further including a plurality of attachment means at spaced intervals along each vertical member comprising a means for releasably attaching a plurality of brace members between individual adjacent formwork support member or members to form a rigid structure.

In a further aspect, the invention may be said to reside in a scaffold structure comprising at least a pair of adjacent formwork support members, each formwork support member comprising at least two spaced vertical members, at least one connecting members bridging said vertical members to form thereby a rigid formwork support member, each vertical member including a plurality of attachment means at spaced intervals there-along, the scaffold structure further comprising at least one brace member extending between and releasably attached at each end thereof to the adjacent formwork support members.

In yet a further aspect, the invention may be said to reside in an assembly of at least a pair of the above described scaffold structures, where these are bridged by at least one brace member releasably attached at each end thereof to the scaffold structures.

In yet a further aspect, the invention may be said to reside in a formwork support member comprising a single vertical member, and a plurality of attachment means at spaced intervals there-along for releasable attachment thereto of at least one brace member extending between adjacent formwork support members to form a rigid structure.

A detailed description of one or more embodiments of the invention is provided below along with accompanying figures and photographs that illustrate by way of example the principals of the invention. While the invention is described in connection with such embodiments, it should be understood that the invention is not limited to any particular embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention.

The present invention may be practiced according to the claim without some or all of the specific details. For the purpose of clarity, technical material is known in technical fields related to the invention has not been described in detail so that the present invention is not unnecessarily obscured.

BRIEF DESCRIPTION OF DRAWINGS

Embodiments of the present invention will be discussed with reference to the accompanying drawings wherein.

In the following description, like reference characters designate like or corresponding parts throughout the figures.

DESCRIPTION OF EMBODIMENTS

Figure 1:
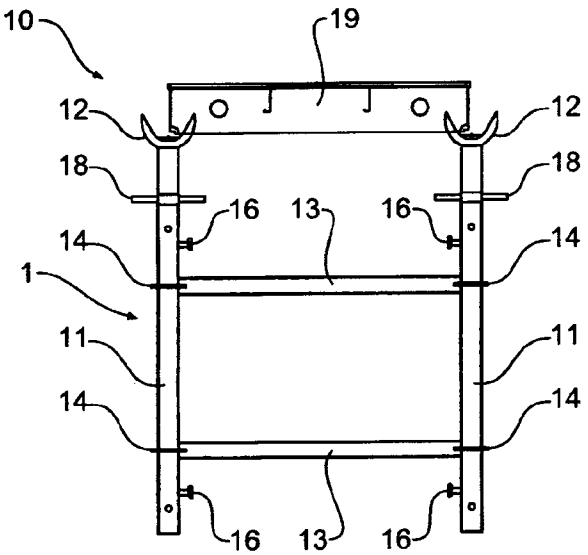
FIG. 1 is an end view of a scaffold structure according to a first embodiment.
Figure 2:
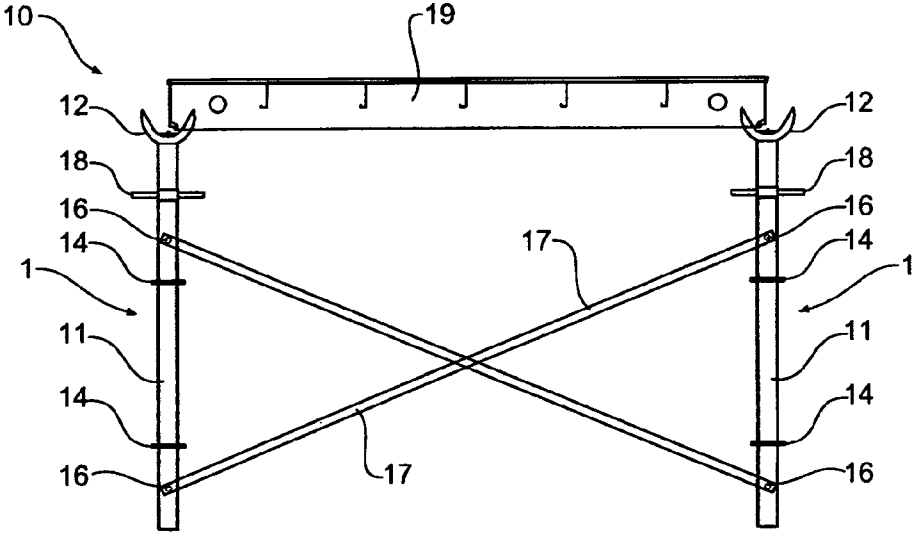
FIG. 2 is a side view of the scaffold structure of FIG. 1.
Figure 3:
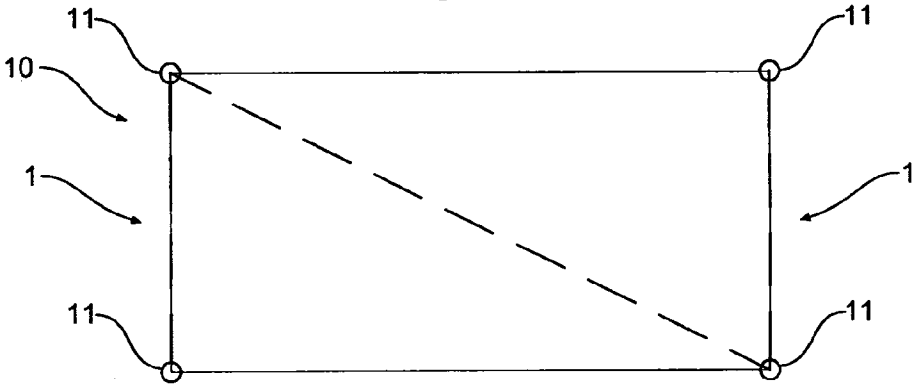
FIG. 3 is a schematic representation of the scaffold structure of FIG. 1 in plan view.
Figure 5:
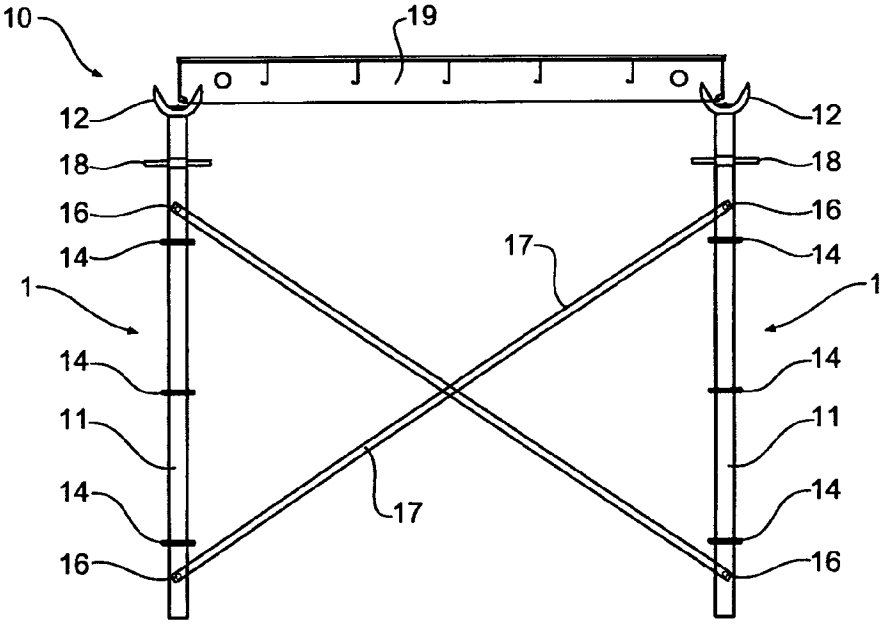
FIG. 5 is a side view of the scaffold structure of FIG. 4.
Figure 6:
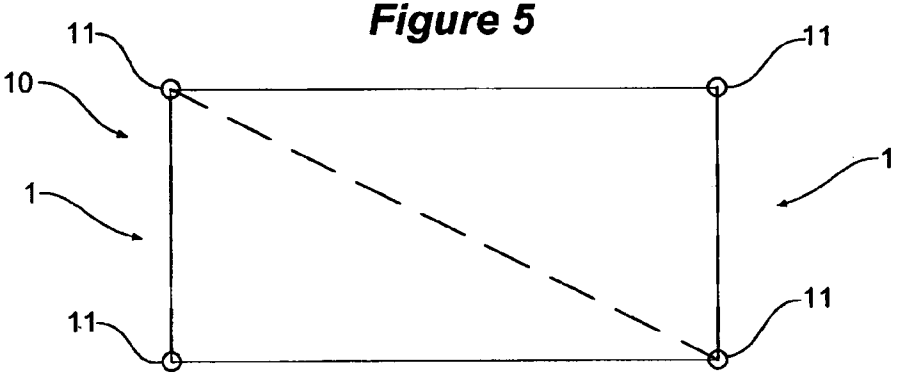
FIG. 6 is a schematic representation of the scaffold structure of FIG. 4 in plan view.
Figure 4:
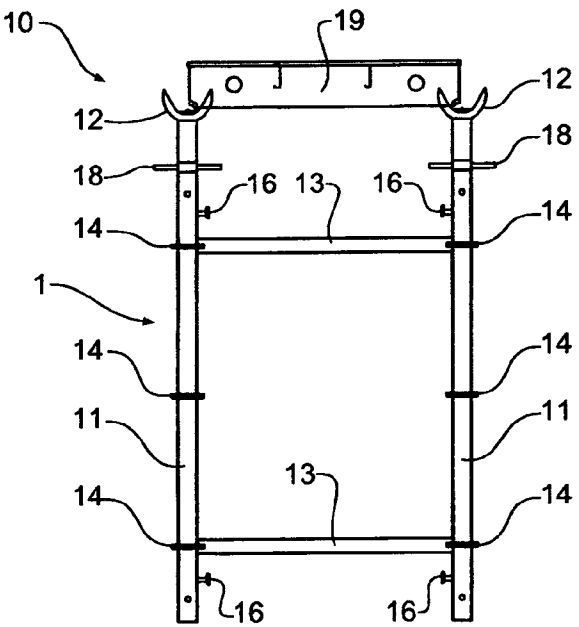
FIG. 4 is an end view of a scaffold structure according to a second embodiment.
Figure 8:
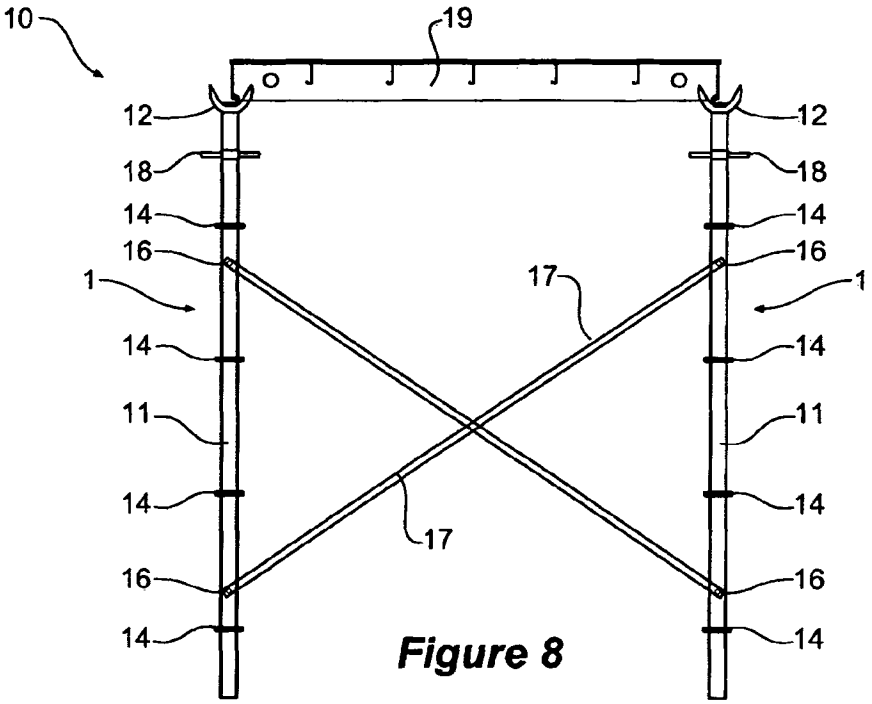
FIG. 8 is a side view of the scaffold structure of FIG. 7.
Figure 9:
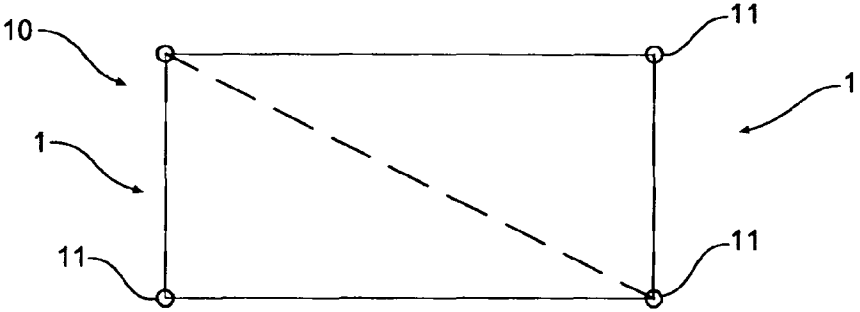
FIG. 9 is a schematic representation of the scaffold structure of FIG. 7 in plan view.
Figure 7:
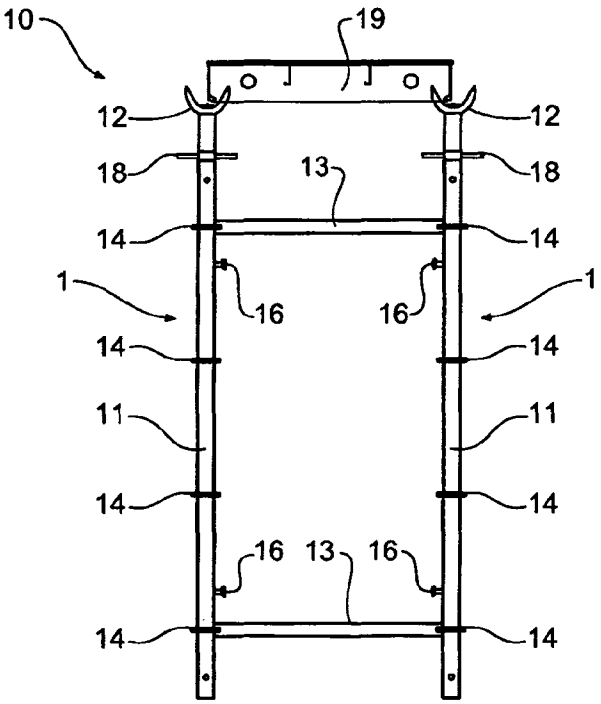
FIG. 7 is an end view of a scaffold structure according to a third embodiment.

Referring now to FIGS. 1 through 9 and 16, where there is shown in each case a scaffold structure 10 each having a common width of 903 mm and a common depth of 1800 mm, but differing heights.

Each scaffold structure 10 comprises two formwork support members 1, where each formwork support member 1 comprises two spaced vertical members 11, and a pair of horizontal connecting members 13 extending between and welded to the vertical members 11. This combination of the vertical members 11 and connecting members 13 forms a rigid formwork support member 1.

Each of the vertical members illustrated in FIGS. 1 through 9 includes a plurality of attachment means 14 at spaced intervals there-along, and a fork 12 at the upper end thereof. Each fork 12 is supported on a jacking extension comprising a screw threaded portion with a rotatable collar 18 against which the base of the fork 12 abuts to enable the fork to be raised or lowered to the required position.

The attachment means 14 take the form of locking rings 14 for releasable attachment thereto of at least one brace member (diagonal and/or horizontal) extending between adjacent formwork support members 1 to form a rigid scaffold structure 10.

Figure 10:
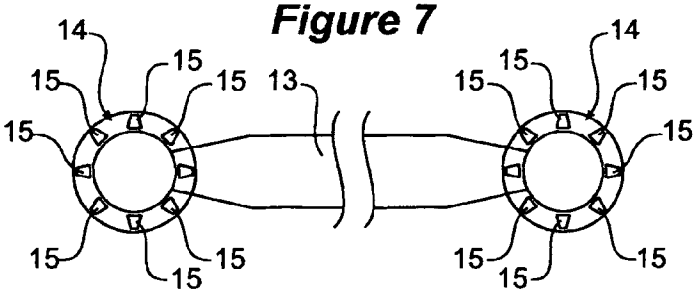
FIG. 10 is a cross-sectional view taken at 1-1 of FIG. 1, and detailing attachment means.

With reference to FIG. 10, it can be seen that each locking ring 14 has an inner diameter which equals the outer diameter of the vertical members 11 so that each locking ring 14 can be slid into position prior to fixing by welding. Each locking ring 14 comprises eight (8) single apertures 15 equally spaced around the locking ring 14. In this way, the ends of multiple brace members can be attached thereto, with these brace members extending at various angles as required.

In addition to a number of locking rings 14 spaced along each vertical member 11, each vertical member 11 has a pair of latch pins 16 that are used for securing a diagonal brace 17, although diagonal braces 17 could be attached via locking rings 14. Each latch pin 16 comprises a pin secured to the vertical members 11 with a movable gravity pin located at its end. The gravity pin can be held in a horizontal position parallel to the main pin to make it easy to attach the diagonal brace 17 whereupon once the diagonal brace 17 is located on the pin, the gravity pin can be moved from its horizontal position where it drops to a vertical position to thereby prevent release of the diagonal brace 17. Each diagonal brace 17 has a pin aperture at each end which enables rapid attachment of the diagonal braces between adjacent formwork support members.

Figure 16:
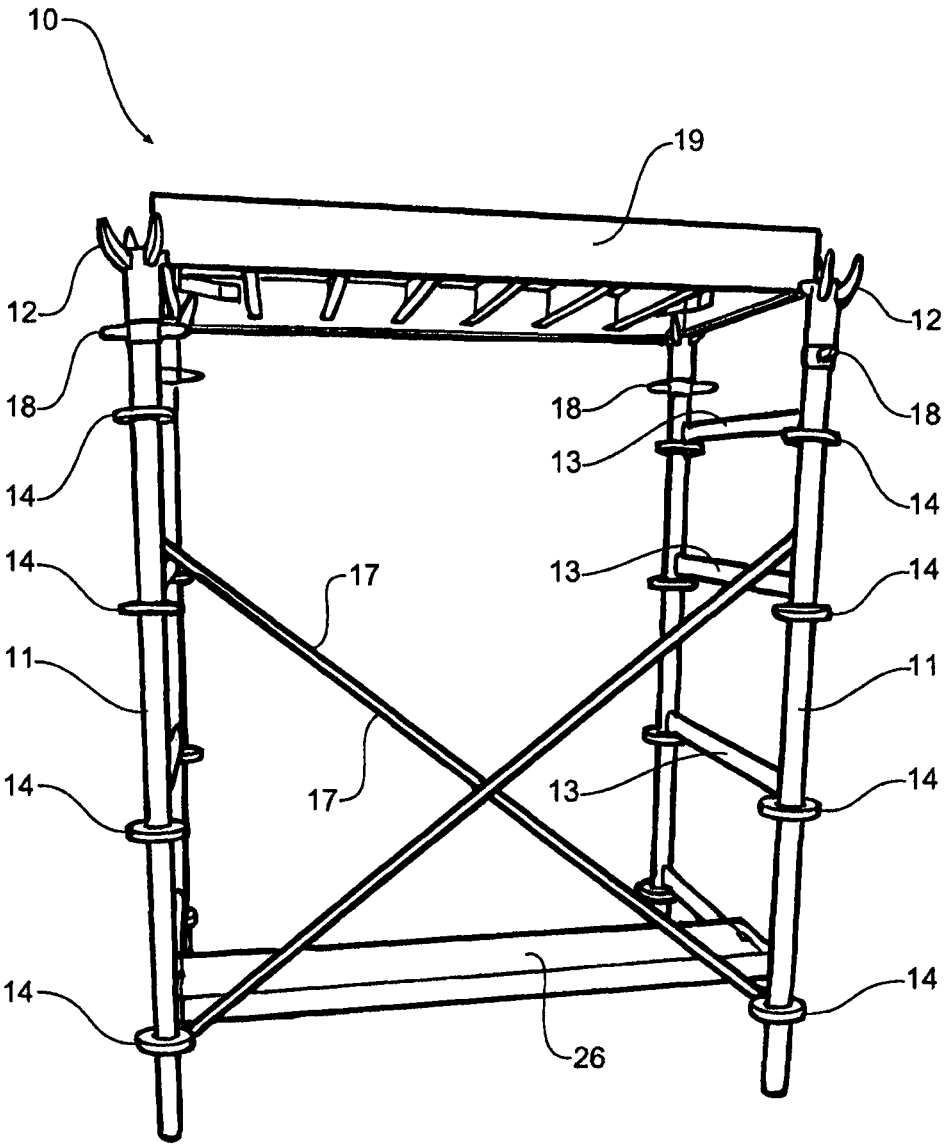
FIG. 16 is a perspective view of the scaffold structure of FIG. 4.

In order to assemble a scaffold structure 10 like that illustrated in FIG. 16, a pair of formwork support members 1 are held in a vertical position and a diagonal brace 17 is attached to a lower latch pin 16 on one of the formwork support members 1, and is then attached to an upper latch pin 16 on the adjacent formwork support member 1. In this way, four diagonal braces 17 extend between a pair of formwork support members 1 to thereby form a scaffold structure 10.

FIGS. 1 and 16 also show an aluminium formwork pan 19 sitting on the four forks 12 of the scaffold structure 10. The pan 19 uses one finger from each of the four forks 12 on the scaffold structure 10.

Figure 11:
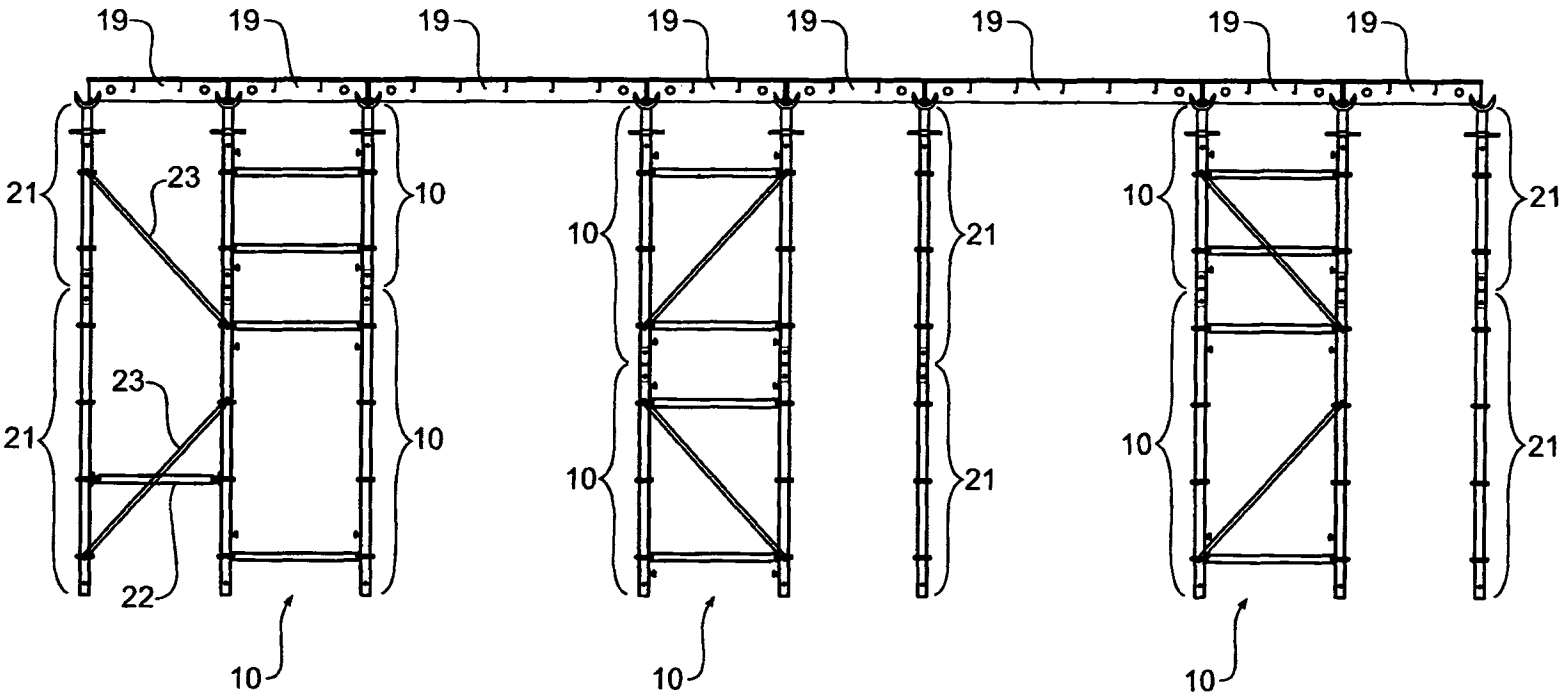
FIG. 11 is an end view of an assembly of scaffold structures.
Figure 12:
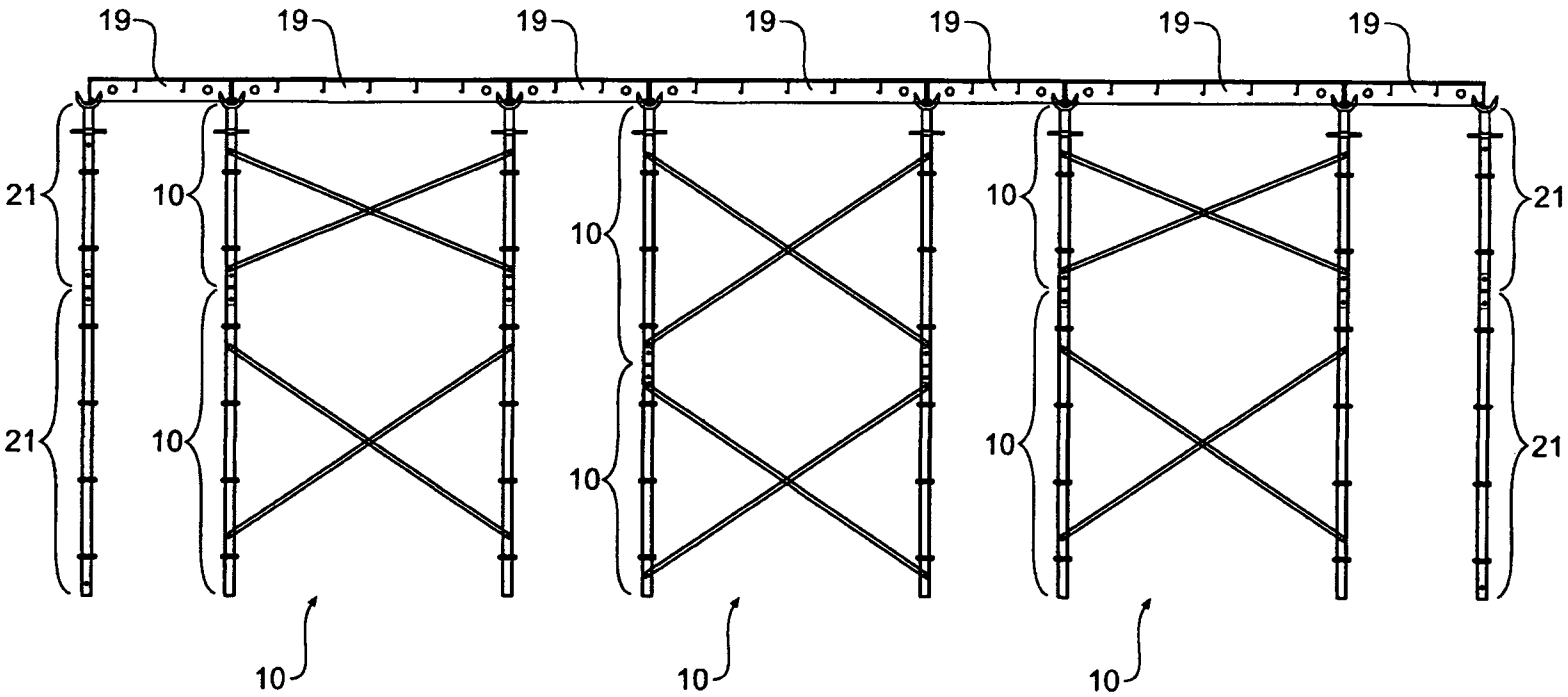
FIG. 12 is a side view of the assembly of FIG. 11.
Figure 13:
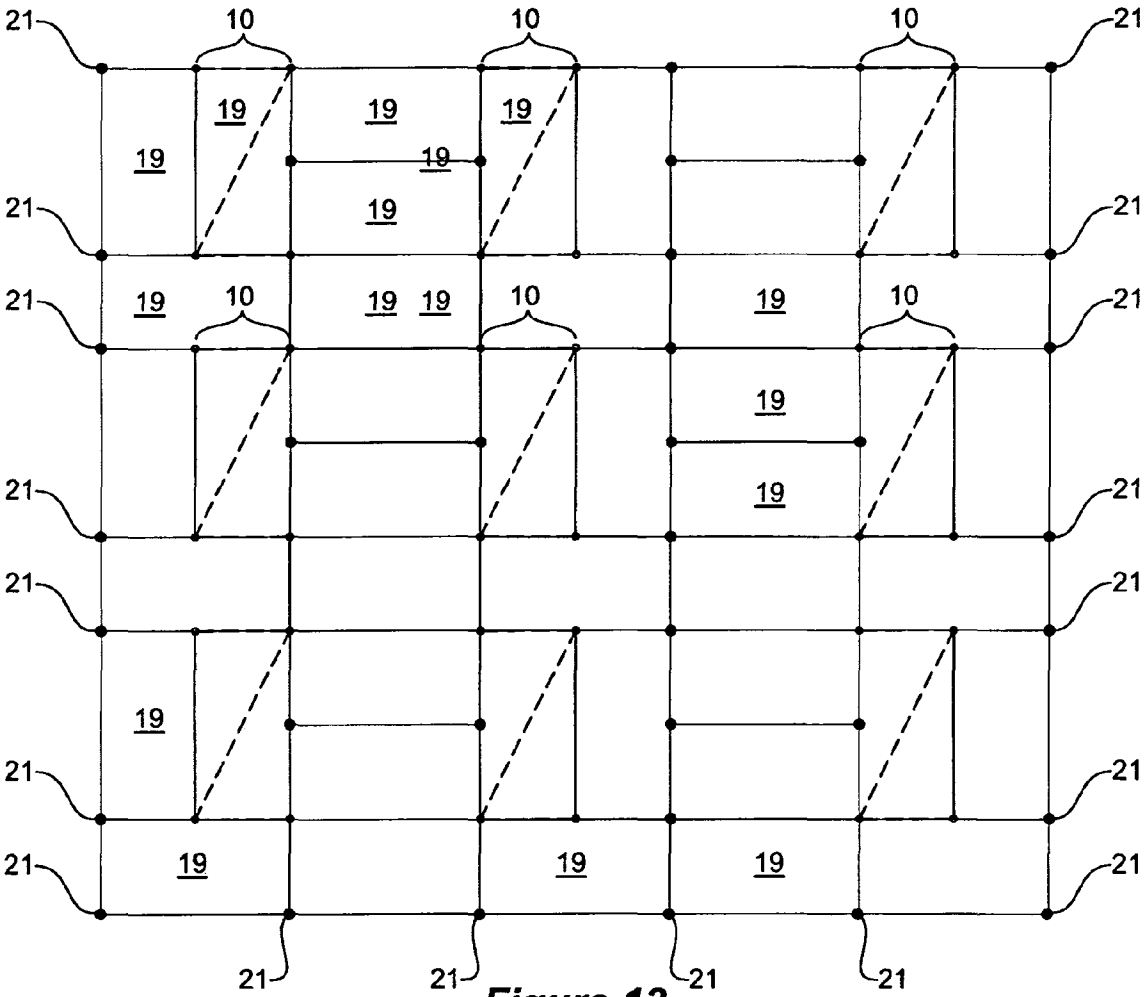
FIG. 13 is a schematic representation of the assembly of scaffold structures of FIG. 11 in plan view.

Referring now to FIGS. 11 and 12, where there is illustrated an assembly of scaffold structures 10, where additional formwork support members 21 are positioned adjacent to the scaffold structures 10 and held in place by horizontal brace members 22 and additional diagonal members 23. These additional formwork support members 21 comprise a single vertical member 11 supporting locking rings 14 and one fork 12.

Figure 18:
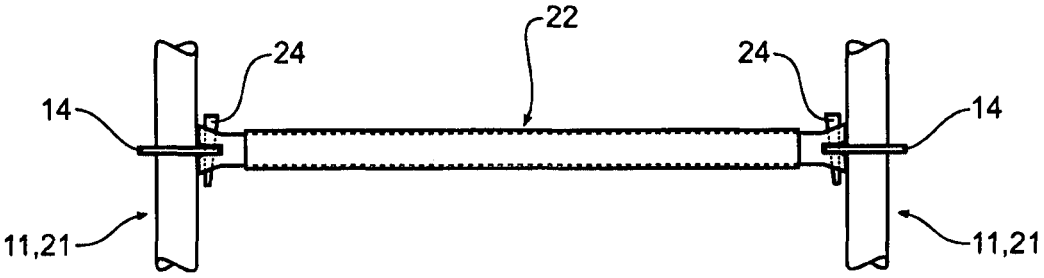
FIG. 18 is a detail view of an attachment point between a brace member and a pair of vertical supports.

With reference to FIG. 18, it can be seen that the brace members 22 and 23 are secured at each end to a respective aperture 15 in a locking ring 14 by way of comprising bifurcate ends, both parts of which include an aperture for alignment with the required aperture 15 in the locking ring 14; in this way these aligned apertures can receive a downwardly inserted wedge shaped pin 24 to secure the brace member 22 or 23 to the locking ring 14.

Alternatively, the additional formwork support members 21 can be free standing and supported only by way of the fork 12 at its upper end engaging with the formwork pan 19 that extends from the adjacent scaffold structure 10.

The resultant assembly of scaffolding structures 10 assembly has a number of evenly spaced forks 12 which enable placement of formwork pans 19 onto the structure to provide a continuous formwork surface on which to pour concrete.

Figure 17:
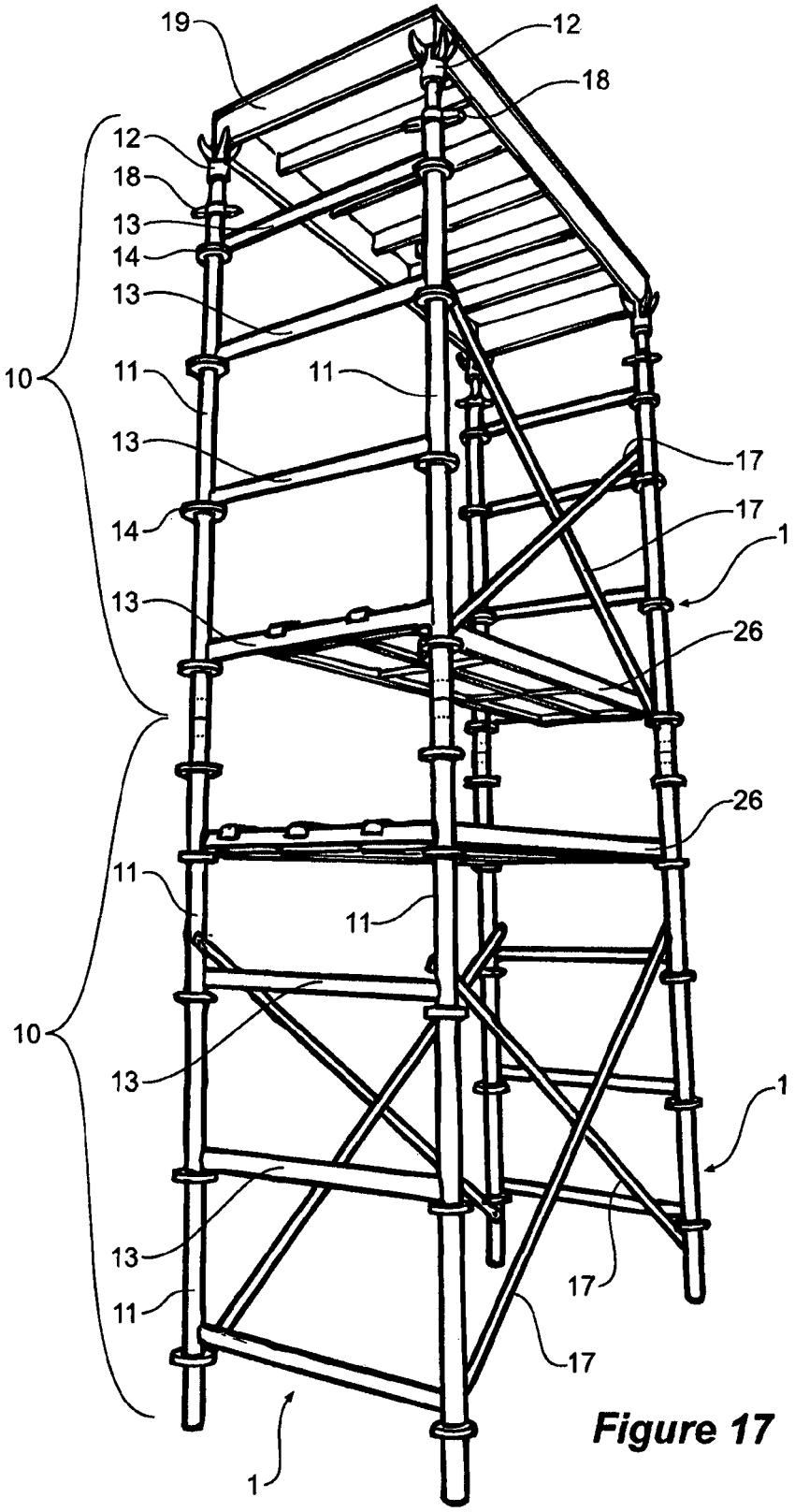
FIG. 17 is a perspective view of an assembly of scaffold structures.

As seen in FIGS. 11, 12 and 17, the scaffold structures 10 can be stacked (in pairs in this case) one on top of the other. Dowel joiners (illustrated with dashed lines in FIG. 17) are used to secure the upper scaffold structure 10 to the lower one. The joiner 25 is located into the upper end of the vertical member 11 is bolted in place and the upper vertical member 11 is located over the extending joiner 25 and again bolted into place. As such, the upper scaffold structure 10 can be quickly and easily positioned on top of the lower scaffold structure 10.

Likewise, the additional formwork support members 21 can be assembled in a similar manner using the joiners 25.

Figure 14:
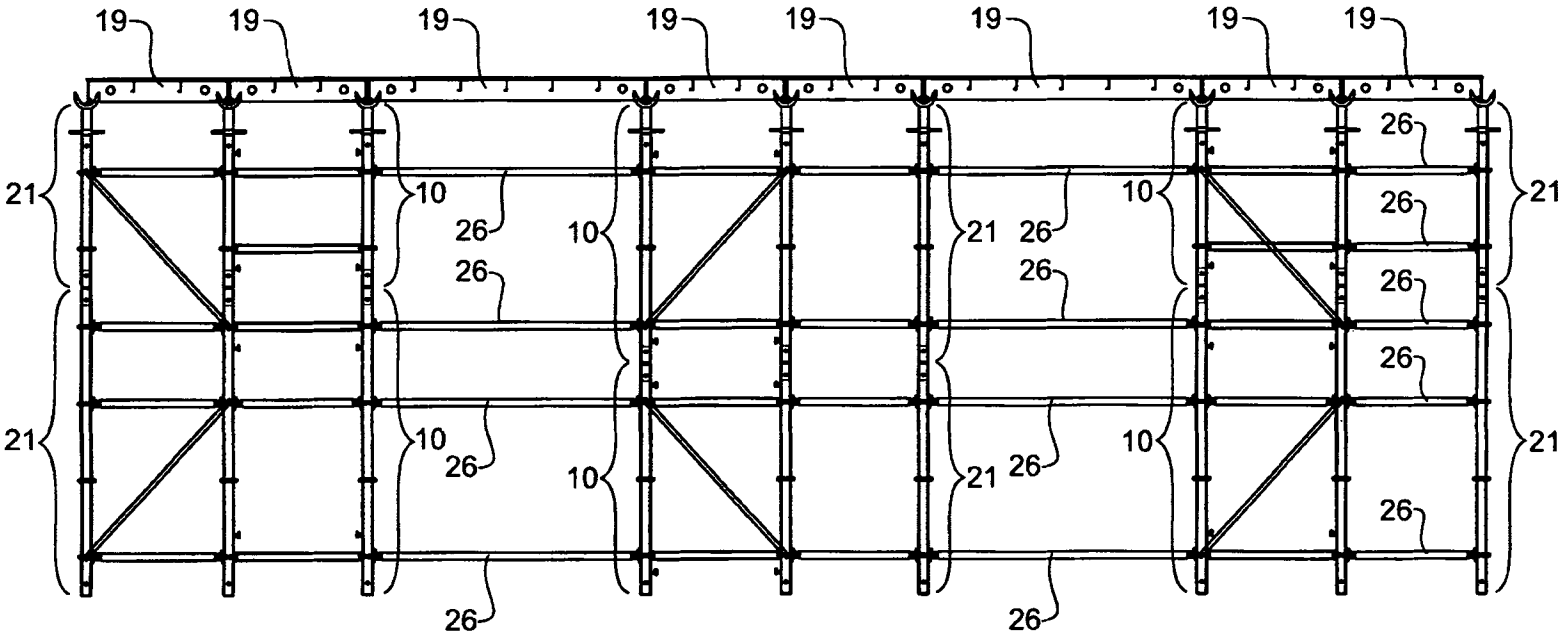
FIG. 14 is an end view of the assembly of FIG. 11, further comprising decking members.
Figure 15:
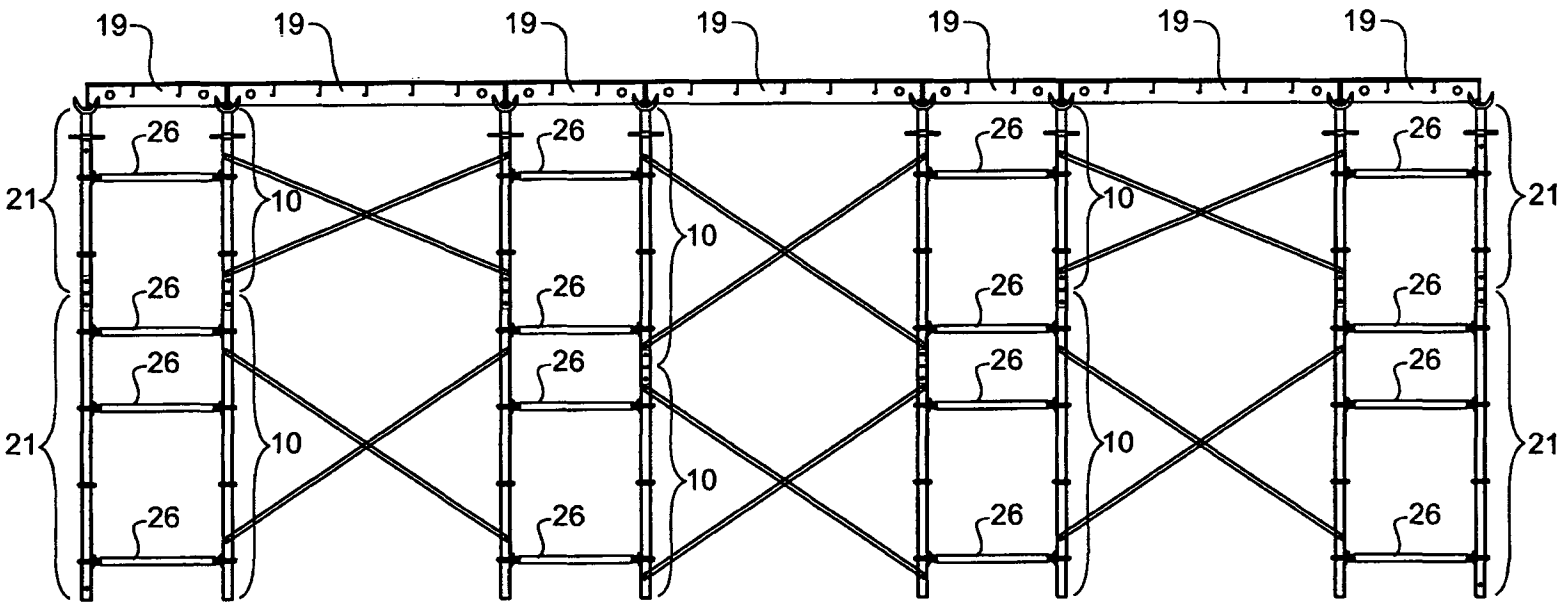
FIG. 15 is a side view of the assembly of FIG. 11, further comprising decking members.

Referring now to FIGS. 14 and 15, where there is illustrated the assembly of scaffolding structures 10 of FIGS. 11 and 12, with deck elements 26 extending horizontally through the rigid scaffolding structure 10. The deck elements 26 comprise a panel with a u-shaped connector at each of the panels with the u-shaped connector sitting on top of the connecting members 13. This provides a continuous walkway through adjacent scaffold structures 10. In this arrangement, the deck elements 26 are positioned between adjacent formwork support members comprising single scaffold structure 10, and additional deck elements 26 extend between adjacent scaffold structures 10. This provides an elevated working surface which gives required access to the upper portions of the lower scaffold structures 10 in order to place the upper scaffold structures 10 in place and provide access to the forks 12 and the fork extension elements. Finally, it provides a safe working surface in order to locate the formwork pans 19 within the respective forks 12.

A brace member 22 extends between adjacent scaffold structures 10 with wedge pins located through each end of the brace member 22 and a u-shaped metal strip 27. The wedge pin locks the joint between the brace member 22 and the u-shaped metal strip 27 to form a solid joint and the wedge pin may be provided with a safety locking pin at its lower end to prevent accidental release of the wedge pin.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. A formwork support member comprising;

at least two spaced vertical members; and at least one connecting member extending between and fixed to said vertical members to form a rigid formwork support member, each vertical member comprising;

a plurality of attachment means at spaced intervals there-along adapted for releasable attachment thereto of a plurality of brace members extending between adjacent formwork support members to form a rigid structure; and at least a pair of latch pins spaced apart along the vertical member; and wherein each of the attachment means comprises a ring around its vertical support member, the ring comprising a plurality of apertures spaced apart around the ring.

2. The formwork support member as in claim 1, further comprising a forked element atop of each vertical member.

3. The formwork support member of claim 2, wherein the vertical support member comprises jacking means for raising and lowering the forked element.

4. The formwork support member as in claim 1, wherein an upper end of each vertical member is adapted to support a second formwork support member atop of it, where each vertical member is attached to an adjacent lower vertical member of the lower formwork support member.

5. The formwork support member of claim 1, wherein each latch pin comprises a movable gravity pin for attaching a diagonal brace.

6. A scaffold structure comprising:

at least a pair of adjacent formwork support members, each formwork support member comprising;

at least two spaced vertical members;

at least one connecting member extending between and fixed to said vertical members, each vertical member comprising:

at least a pair of latch pins, each latch pin adapted for releasable attachment thereto of a diagonal brace; and a plurality of attachment means at spaced intervals along the vertical member, each of the attachment means comprising;

a ring around the vertical member, the ring comprising a plurality of apertures spaced apart around the ring, and the scaffold structure further comprising:

at least a pair of diagonal brace members, each of which extends between and is releasably attached to a lower latch pin on one of the formwork support members, and an upper latch pin on the adjacent formwork support member.

7. The scaffold structure of claim 6, comprising a plurality of brace members extending between and releasably attached at each end thereof to attachment means of the adjacent formwork support members.

8. The scaffold structure of claim 6, wherein the pair of formwork support members are secured to one another by four diagonal braces comprised of two pairs of diagonal brace members, one pair each extending between two spaced vertical members.

9. The scaffold structure as in claim 6, further comprising at least one horizontal brace member extending between and releasably attached at each end thereof to attachment means of the adjacent formwork support members.

10. The scaffold structure of claim 6, further comprising at least one deck element bridging any one of a pair of connecting members, a pair of horizontal brace members, or a connecting member and a horizontal brace member.

11. The scaffold structure as in claim 6, wherein each attachment means is adapted for releasable attachment thereto of a plurality of connecting members and/or brace members.

12. The scaffold structure as in claim 6, further comprising a forked element atop of each vertical member.

13. The scaffold structure of claim 12, wherein the vertical support member comprises jacking means for raising and lowering the forked element.

14. The scaffold structure of claim 6, wherein an upper end of each vertical member may be used to support a second formwork support member atop of it, where each vertical member is attached to an adjacent lower vertical member of the lower formwork support member.

15. The scaffold structure of claim 6, wherein each latch pin comprises a movable gravity pin for attaching a diagonal brace.

16. An assembly of scaffold structures comprising at least a pair of the scaffold structures of claim 7, and at least one brace member extending between and releasably attached at each end thereof to the adjacent formwork support members.

17. The assembly of scaffold structures of claim 16, wherein the pair of scaffold structures comprises a lower ground engaging scaffold structure and a second scaffold structure stacked atop the lower ground engaging scaffold structure.

18. An assembly of scaffold structures comprising a scaffold structure of claim 7 stacked atop of a second scaffold structure, said second scaffold structure comprising at least a pair of adjacent formwork support members, each formwork support member comprising at least two spaced vertical members, at least one connecting member bridging said vertical members, each vertical member including a plurality of attachment means at spaced intervals therealong, the scaffold structure further comprising at least one brace member extending between and releasably attached at each end thereof to the adjacent formwork support members.

* * * * *